United States Patent [19]

Stadden

[11] Patent Number: 4,630,831

[45] Date of Patent: Dec. 23, 1986

[54] TILE GAME

[76] Inventor: Cecine B. Stadden, 169 Giffin, Los Altos, Calif. 94022

[21] Appl. No.: 725,224

[22] Filed: Apr. 19, 1985

[51] Int. Cl.[4] ..... A63F 9/20

[52] U.S. Cl. ..... 273/292

[58] Field of Search ..... 273/292, 303, 272, 275, 273/306, 304

[56] References Cited

U.S. PATENT DOCUMENTS

| | | | |
|---|---|---|---|
| 2,162,876 | 6/1939 | Barton | 273/275 X |
| 4,004,812 | 1/1977 | Lutz | 273/292 |
| 4,376,538 | 3/1983 | Keenan | 273/275 |

FOREIGN PATENT DOCUMENTS

| | | | |
|---|---|---|---|
| 2293228 | 7/1976 | France | 273/292 |

OTHER PUBLICATIONS

Advertising brochure for game entitled "AC/DC", 1 sheet.

*Primary Examiner*—Anton O. Oechsle

*Attorney, Agent, or Firm*—Willis E. Higgins

[57] ABSTRACT

A tile game uses a first plurality of tiles (12) having binary numbers shown on them. The tiles (12) are assembled in strings (32) by matching beginning and/or ending digits. A second plurality of tiles (14) have computer and plug indicia (22 and 24). They are incorporated in the strings (32) to validate potential scores represented by the first plurality of tiles (12) in the strings (32). A third plurality of tiles (16) show blown fuses and are used to cancel the validated potential scores in the strings (32). The tiles (12), (14) and (b 16) are divided into differentiated sets for separate use by players of the game.

7 Claims, 3 Drawing Figures

TILE GAME

BACKGROUND OF THE INVENTION

1. Field of the Invention

This invention relates to a game of amusement. More particularly, it relates to such a game in which the players form strings of tiles by playing in turn. Most especially, it relates to such a game utilizing binary numbers and a computer theme.

2. Description of the Prior Art

A variety of games is known in the art in which the players form strings of tiles. Examples of such games include dominoes and Scrabble. In these games, the strings are formed by matching the number of dots on an end tile and by forming words from the tiles, respectively. While these games continue to maintain their popularity, there is substantial interest among game players in new games that incorporate challenging and surprising elements.

SUMMARY OF THE INVENTION

Accordingly, it is an object of this invention to provide a tile game incorporating surprising changes in the progress of the game.

It is another object of the invention to provide such a tile game which will promote familiarity with the binary number system.

It is a further object of the invention to provide such a tile game in which potential scores may be earned, lost and recaptured.

The attainment of these and related objects may be achieved through use of the novel tile game herein disclosed. A tile game in accordance with this invention utilizes a first plurality of tiles bearing first indicia. The first plurality of tiles is configured to be assembled in strings by matching at least a portion of the first indicia. A second plurality of tiles bears second indicia and is configured for incorporation in the strings to validate the strings. A third plurality of tiles bears third indicia and is configured for incorporation in the strings to cancel the validated strings. The first, second and third pluralities of tiles are each divided into differentiated sets for separate use by players of the game.

In use, the game is played by assigning a set of the tiles to each player. Strings of the first plurality of tiles are formed by each player in turn connecting a tile of the first plurality to a previously played tile of the first plurality by matching at least a part of the indicia between the tiles. When a string of sufficient length for validation is present, the players may attach tiles of the second plurality to validate the scores. The tiles of the third plurality may then be used to cancel a validated string or to revalidate a cancelled string.

The sequence of forming a string of tiles, validating the string and cancelling a validated score produces different and surprising outcomes for the game each time it is played. The game therefore has continuing amusement value. If binary numbers are used as the first indicia, the game can be used to promote familiarity with the binary number system.

The attainment of the foregoing and related objects, advantages and features of the invention should be more readily apparent to those skilled in the art, after review of the following more detailed description of the invention, taken together with the drawings, in which:

DETAILED DESCRIPTION OF THE INVENTION

Figure 1:
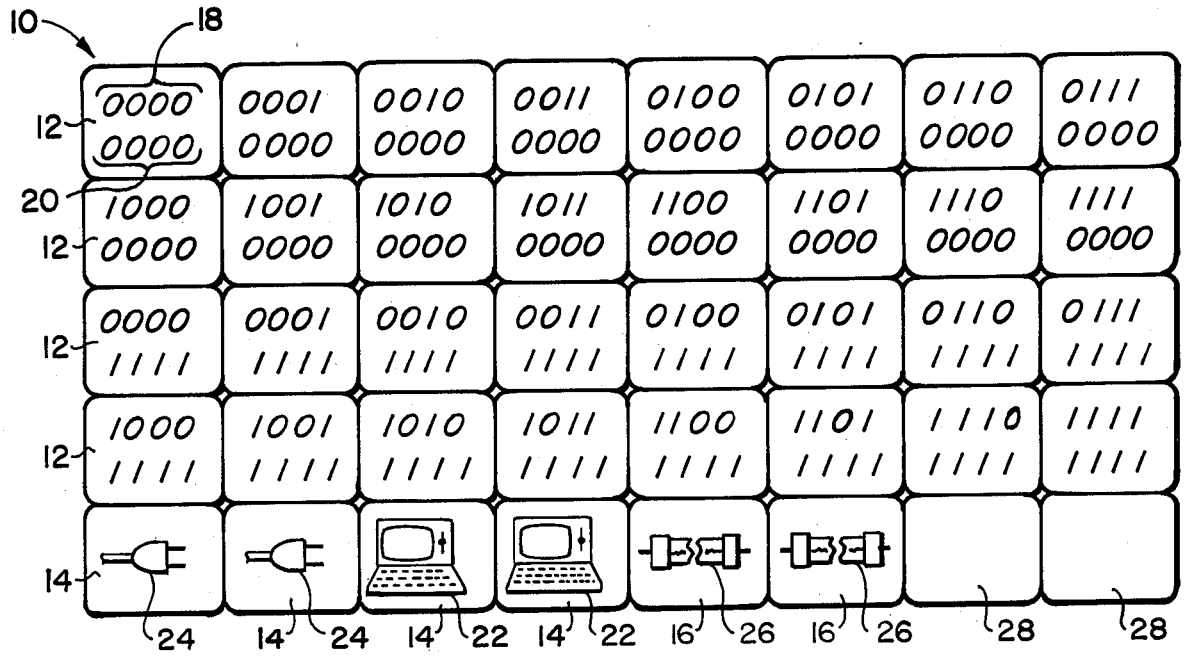
FIG. 1 is a plan view of a set of tiles for playing the game of this invention.

Turning now to the drawings, more particularly to FIG. 1, there is shown a collection 10 of tiles 12, 14 and 16, comprising the tile game of this invention. The tiles 12 each contain an upper four bit binary number 18 and a lower four bit binary number 20. Each of the tiles 14 contains either a representation of a computer unit 22 or a plug 24. Each of the tiles 16 contains a representation of a blown fuse 26. Additionally, four blank tiles 28 are provided, which may be used in the game in the same manner as a tile 16.

The tiles 12 are provided as two sets of 32 tiles each in contrasting colors, for example, red and white. The 32 red tiles 12 containing the same sets of numbers as the 32 white tiles 12. For simplicity, only one set of the 32 different binary number combinations is shown. Similarly, there are two white computer unit tiles 14, two red computer unit tiles 14, two white plug tiles 14 and two red plug tiles 14. There are also two white blank tiles 28 and two red blank tiles 28.

The object of the game is to score points, measured by the binary number tiles 12, by assembling a string of the tiles 12 with a computer tile 14 of your color at one end of the string and a plug tile 14 of either color at the other end of the string. Opponents' scores can be cancelled out with use of the blown fuse tile 16, and the blank tiles can be used in much the same manner as blown fuse tiles 16. The game may either be played for a predetermined number of times, such as eight rounds, with the highest score at that time being the winner, or on the basis of the first player to score a predetermined number of points, such as 512 points. The game may be played with either two or four players, and will be explained in the two player mode.

Play begins by each player selecting one of the different colored sets of tiles which are initially face down. The 32 tiles 12 and the two tiles 28 in each set constitute a player's bank, with the six tiles 14 and 16 constituting a separate symbol bank. Each player chooses ten tiles from the bank. The tiles drawn by each player are not revealed to the opponent until played. The tiles are turned face up only as played, and are played one at a time, in turn.

Figure 2:
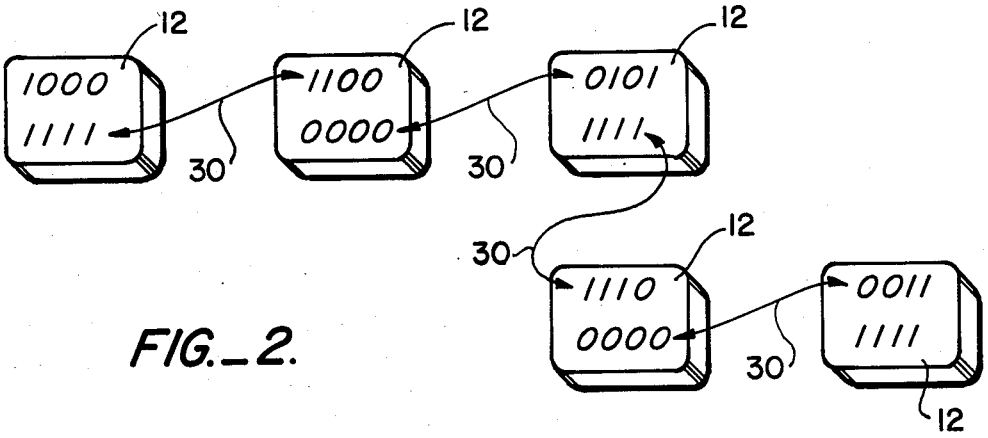
FIG. 2 is a diagram showing how a portion of the game is played.

FIG. 2 shows how the tiles 12 are played. After the first tile has been played face up, the players in succession must match one of the end or beginning digits of their tile with an end or beginning digit not already matched in a previous play of a tile that has already been played, as indicated by arrows 30. In addition to horizontal and vertical positioning as shown in FIG. 2, diagonal positioning is possible when the tiles involved begin and end with all ones or all zeros.

If a player after the first move is unable to build on the strings or block of tiles already played, they must draw a tile 12 from the bank. If the bank tile is unplayable, they must draw again from the bank, and a third time if still unable to play. If unable to play after three draws from the bank, then the play passes back to the other side. If a player plays a subsequent tile drawn from the bank, he or she must then try to play the original tile first drawn.

Unlike the tiles 12, the blank tiles 28 when drawn may be held back for later play for strategic reasons. A blank is used to cancel an opponent's tiles and scores. The all-binary ones and all-binary zeros tiles (1111 1111 or 0000 0000) 12 of either side can play on any blank. Otherwise a blank cannot be played on by an opponent until you have played on it. The blank remains face up on the board until it is played. A blank can blank out an opponent's blank and cancel opponent's score in that line. A blank 28 is used to form a number string or block in the same manner as a tile 12.

Figure 3:
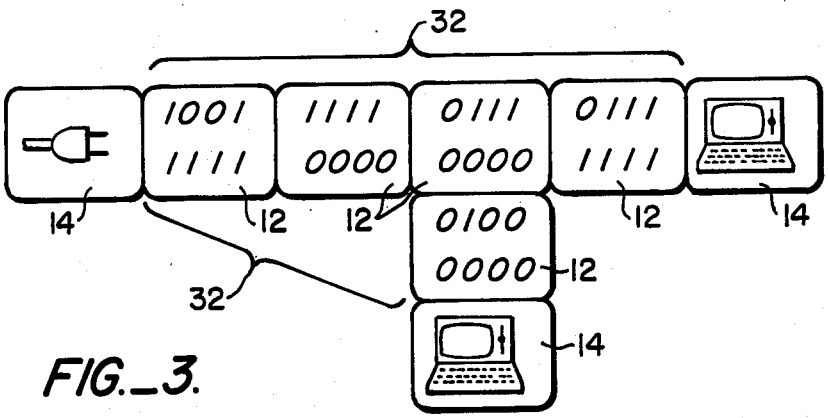
FIG. 3 is another diagram showing a further portion of the game.

Playing a tile 12 that contains the same binary numbers as a tile 12 that has already been played is called twinning Playing such a tile 12 unlocks the symbol bank. A symbol tile 14 or 16 may then be drawn. Like the blank tiles 28, the symbol tiles 14 and 16 may either be held back or played when drawn. If a drawn symbol tile 14 or 16 is not played, a player may draw from the bank and play the drawn tile 12 instead. Playing a tile 12 that matches an opponent's tile is the only way to be allowed to draw from the symbol bank. The symbol bank consists of two computer tiles 14, two plug tiles 14 and two blown fuse tiles 16 in each selected color. As shown in FIG. 3, a computer tile 14 can be placed anywhere at an end of a string 32 of four or more tiles 12. A plug tile 14 can be played at the other end of any string 32 of at least four tiles 12 between the plug tile 14 and the computer tile 14. Any continuous string of tiles, straight or angled, can be used. More than one computer tile 14 can be connected to a plug tile 14 by overlapping strings 32 of tiles 12, as shown in FIG. 3. No one can play off the end of the computer or plug tiles 14, but anyone can play off any tile 12 which is part of a string having a plug tile 14 at one end and a plug tile 14 at the other end.

A blown fuse tile 16 is used to cancel any string 32 of tiles 12 and remove the score of an opponent for that string 32 in which the fuse is played. A fuse tile 16 is played on top of an opponent's tile 12. Another fuse tile 16 can cancel a previously played fuse tile 16. In fact, if the last play of the game is a fuse tile 16, it can wipe out almost all the opponent's score.

Intelligent use of the blank tiles 28 and the fuse tiles 16 can produce many interesting and unexpected twists in the final outcome of the game. For example, when a player plays their last tile 12, he or she can hold back symbol tiles 14, 16 or blank tiles 28 forcing the opponent to play all of his or her tiles. If a blank tile 28 or a fuse tile 16 is held back, it can be used to stop an opponent from taking away a score. Such a play also then cancels any score in the fuse string 32 of the opponent.

When one player has played his or her last tile 12, the opponent has to play out all of his or her remaining tiles 12, or is penalized for each one he or she is unable to play, and the opponent can earn no score for playing the remaining tiles. However, if the opponent has a blank tile 28 or a fuse tile 16, it can totally wipe out your score.

The above explanation has been for a two person game. When four people play, each player draws either eight or ten tiles, and the symbol tiles 14, 16 and blank tiles 28 are divided equally. Two players with the same color tiles should be partners, with each partner drawing three symbols. The symbol tiles are face down and not known until they are drawn.

A wide variety of scoring methods can be used for the game. The following table shows points awarded for various plays in addition to the numerical values shown on the tiles of a string 32 earned by a player in a method of scoring by fives and a method of scoring by eights (binary scoring).

| Tile When Played | 5's Scoring (Points) | 8's Scoring (Points) |
|---|---|---|
| 0000 1111<br>0000 1111 | 5 | 8 |
| Line of any 6 in any direction, in your color | 15 | 32 |
| Run of any color, 8 in a row | 10 | 16 |
| One color block of six tiles | 15 | 32 |
| Line of your color of eight | 20 | 40 |
| One color block of eight tiles | 25 | 48 |
| Line of 12, any color | 15 | 40 |
| A COMPUTER AND PLUG | 30 | 64 |
| First out of tiles | 10 | 16 |
| You get 5 points for each of your opponent's unplayed tiles | | |

The points for strings of eight and 12 tiles of either color in a row are awarded to the player making the last play to complete such a string. The blocks are formed by adjacent rows or columns of tiles which form a two-dimensional, overlapped array.

Game is either the first to score 512 or the best score of eight games. Knowledge of binary arithmetic can be facilitated by adding up the played tiles in your color and your opponent's color. Alternatively, a binary calculator or computer could be used for this purpose.

It should now be apparent to those skilled in the art that a novel tile game capable of achieving the stated objects of the invention has been provided. The approach of validating scores represented by the tiles 12 with the symbol tiles 14 and of cancelling and/or reestablishing validated scores with the tiles 16 and 28 introduces and interesting and surprising outcomes in the game. When binary scoring is employed, the game promotes familiarity with the binary number system.

It should further be apparent to those skilled in the art that various changes in form and details of the invention as shown and described may be made. For example, any set of two numbers or letters could be used on the tiles 12 in place of the binary numbers shown in a similar manner. It is intended that such changes be included within the spirit and scope of the claims appended hereto.

What is claimed is:

1. A process for playing a game, which comprises providing a first plurality of tiles bearing first indicia, a second plurality of tiles bearing second indicia and a third plurality of tiles bearing third indicia, the first, second and third pluralties of tiles being distinguishable into a set for each player, at least the first indicia having scoring significance, assigning a set of the tiles to each player, distributing at least some of the first plurality of tiles to each player, forming strings of the first plurality of tiles by each player in turn connecting a tile of the first plurality to a previsouly played tile of the first plurality by matching at least a part of the indicia between the tiles of the first plurality, drawing one of said second and third plurality of tiles after forming a string, validating a string in turn by attaching at least one of the drawn second and third plurality of tiles on the string, and cancelling the validated string of an opponent in turn by attaching at least one of the third plurality of tiles to the validated string, the players being required to play their playable tiles of the first plurality, but having discretion to withhold playing their tiles of the second and third plurality of tiles.

2. The process of claim 1 in which a player re-validates a cancelled potential score by also attaching at least one of the third plurality of tiles to the cancelled validated string.

3. The process of claim 1 in which the first indicia in said first plurality of tiles represent binary numbers.

4. The process of claim 3 in which the second indicia on said second plurality of tiles represent computer parts.

5. The process of claim 4 in which the third indicia on the third plurality of tiles represent an electrical circuit component.

6. The process of claim 1 in which said first, second and third pluralities of tiles are divided into differentiated sets by color.

7. The process of claim 1 additionally comprising the step of providing a fourth plurality of tiles which the players use as one of the first and the third plurality of tiles, the players having discretion to withhold playing of their fourth plurality of tiles.

* * * * *